US005491377A

United States Patent [19]

Janusauskas

[11] Patent Number: 5,491,377

[45] Date of Patent: Feb. 13, 1996

[54] ELECTROLUMINESCENT LAMP AND METHOD

[76] Inventor: Albert Janusauskas, 110 Brickyard Rd., Farmington, Conn. 06032

[21] Appl. No.: 101,413

[22] Filed: Aug. 3, 1993

[51] Int. Cl.[6] ..... H01J 1/70

[52] U.S. Cl. ..... 313/506; 313/503; 313/509; 313/512; 428/917

[58] Field of Search ..... 313/506, 503, 313/509, 317, 512; 345/36, 45, 76, 905; 315/169.3; 428/917

[56] References Cited

U.S. PATENT DOCUMENTS

| | | | |
|---|---|---|---|
| 3,274,419 | 9/1966 | Roth | 313/511 X |
| 4,482,841 | 11/1984 | Tiku et al. | 313/506 X |
| 4,617,195 | 10/1986 | Mental | 313/512 X |
| 4,626,742 | 12/1986 | Mental | 313/512 X |
| 4,686,353 | 8/1987 | deSouza | 427/66 X |
| 4,708,914 | 11/1987 | Kamijo | 313/506 X |
| 4,758,765 | 7/1988 | Mitsumari | 313/506 X |
| 4,767,679 | 8/1988 | Kawachi | 313/506 X |
| 4,859,904 | 8/1989 | Higton et al. | 313/506 |
| 4,876,481 | 10/1989 | Taniguchi et al. | 313/506 X |
| 4,902,929 | 2/1990 | Toyoda et al. | 313/506 X |
| 5,051,654 | 9/1991 | Nativi et al. | 313/506 |
| 5,068,157 | 11/1991 | Won | 313/509 X |
| 5,124,204 | 6/1992 | Yamashita et al. | 313/506 X |
| 5,184,969 | 2/1993 | Sharpless et al. | 313/506 X |
| 5,188,901 | 2/1993 | Shimizu | 313/509 X |
| 5,276,382 | 1/1994 | Stocker et al. | 313/506 |
| 5,313,141 | 5/1994 | Kimball | 315/169.3 |
| 5,332,946 | 7/1994 | Eckersley et al. | 313/506 |
| 5,347,198 | 9/1994 | Kimball | 315/169.3 |
| 5,349,269 | 9/1994 | Kimball | 315/169.3 |

*Primary Examiner*—Sandra L. O'Shea
*Assistant Examiner*—Ashok Patel
*Attorney, Agent, or Firm*—Rogers & Killeen

[57] ABSTRACT

A flexible, thick film, electroluminescent lamp and method of construction in which a single non-hygroscopic binder is used for all layers (with the optional exception of the rear electrode), thereby reducing delamination as a result of temperature changes and the susceptibility to moisture. The binder includes a fluoropolymer resin, namely polyvinylidene fluoride, which has ultraviolet radiation absorbing characteristics. The use of a common binder for both phosphor and adjacent dielectric layers reduces lamp failure due to localized heating, thus increasing light output for a given voltage and excitation frequency, and increasing the ability of the lamp to withstand overvoltage conditions without failure. The lamps may be made by screen printing, by spraying, by roller coating or vacuum deposition, although screen printing is preferred. By the multilayer process, unique control of the illumination is achieved.

16 Claims, 1 Drawing Sheet

ELECTROLUMINESCENT LAMP AND METHOD

BACKGROUND OF THE INVENTION

Thick film electroluminescent ("EL") lamps are well known and generally comprise a phosphor between an optically transparent front electrode layer and a back electrode layer, all covered by a protective layer. The two electrodes are generally planar layers, but may be grids of electrically conductive material disposed at right angles to each other so that the phosphor at selected grid coordinates can be excited.

In general, different methods are used for depositing the various layers of thin film lamps than are used for thick film lamps. In contrast to thin film lamps made by vacuum deposition of the various layers, usually on glass, thick film lamps are generally made by roller coating the various layers, i.e., from the back forward on foil or a metalized polyester back electrode, or from the front backward on an indium tin oxide ("ITO") sputtered heat stabilized polyester used as the transparent front layer. More recently as shown for example in the Mental U.S. Pat. No. 4,626,742 dated Dec. 2, 1986, the various layers including the electrical connections thereto have been screen printed on a transparent polyester base, particularly where the lamps are of unusual sizes and/or shapes.

A problem common to all of the known techniques for making lamps is the protection of the layers, particularly the phosphor, from moisture. Moisture gives rise to dielectric breakdown and is highly detrimental to both lamp longevity and performance.

Moisture is particularly a problem in the favored screen printing process where the binder resin for the various layers is generally hygroscopic, and where the highly hygroscopic cyanoethly cellulose, often blended with cyanoethyl starch or sucrose, are commonly used. The traditional approach to the moisture problem, as shown for example in the Schimizu U.S. Pat. No. 5,188,901 dated Feb. 23, 1993 and the Kawachi U.S. Pat. No. 4,767,679 dated Aug. 30, 1988, is the encapsulation of the entire lamp in a fluoropolymer or PTCFE film. However, such encapsulation is an expensive and time consuming process.

It is accordingly an object of the present invention to obviate the moisture problem by use of a non-hygroscopic binders throughout the manufacturing process.

It is another object of the present invention to provide a novel EL lamp and process in which the need for an external protective encapsulation is obviated.

One known method of attacking the moisture problem has been to coat the individual phosphor particles with a thin layer (e.g., 0.4 microns) with aluminum oxide. Such lamps, when used with a traditional binder system and overcoating, have shown enhanced moisture resistance, but provide only about one half the illumination of the more traditional uncoated phosphor lamps for the electrical power applied to them.

It is accordingly an object of the present invention to reduce the moisture problem without sacrificing significant illumination by the use of individually coated phosphor particles.

Alternatively, it is another object of the present invention to use the moisture resistant characteristics of individually coated phosphor particles in a lamp capable of operating at higher voltage and frequencies so as to retain the illumination levels of non-coated phosphor particles.

In another aspect, the light emitted by a thick film EL lamp is of course related to the excitation of the phosphor by the electrical current through the lamp, and the current is inversely related to the capacitive reactance and is thus a function of the frequency of the applied electrical signal, i.e., the higher the frequency the lower the capacitive reactance and the brighter the lamp.

However, the use of high frequency excitation of EL lamps presents a problem in the stability of the dielectric. When a lamp is operated at high voltage and above 900 to 1,000 Hz, local heating in the dielectric layer is due to the resistive dissipation of heat in the dielectric/phosphor junction. For this reason, and because of brightness and color rendition, the specifications for most lamps require operation between 400 Hz and 2,000 Hz at 115 volts.

The failure of foil backed lamps from dielectric breakdown is catastrophic, for a low impedance shunt is thereby established between the electrodes. For ITO sputtered polyester front electrode lamps, the electrode generally fuses to open the circuit around the area of dielectric breakdown, producing a dark spot. As the dielectric continues to breakdown, other spots appear quickly degrading the performance of the lamp to an unacceptable level.

It is accordingly an object of the present invention to reduce the incidence of the dielectric breakdown in EL lamps by the use of a common binder in the phosphor and dielectric layers.

It is another object of the present invention to provide a novel EL lamp and process in which the diffusion at the dielectric/phosphor junction is significantly increased.

It is still another object of the present invention to provide a novel EL lamp and process in which the effective surface layer of the phosphor is significantly increased.

It is yet another object of the present invention to provide a novel EL lamp and process which is capable of both continued operation at a higher excitation frequency and intermittent operation (and thus high brightness) at greatly increased excitation frequencies.

In still another aspect, the temperature at which an EL lamp operates often causes delamination or separation of the various layers because of unequal coefficients of expansion of the binders used in the layers. Uneven expansion causes flexing and localized stress which often increases the incidence of failure.

It is accordingly an object of the present invention to obviate the problem of localized stress by use of binders for the various layers which have an uniform coefficient of thermal expansion.

It is another object of the present invention to provide a novel EL lamp and process with significantly reduced mechanical damage as a result of the inherent localized thermal effects due to lamp operation.

In yet another aspect, the darkening of the phosphor in thick film EL lamps has been a problem as a result of ultraviolet ("UV") radiation from exposure to sunlight. The prior art has attempted to reduce the darkening of the phosphor from exposure to sunlight by laminating or coating the lamp with a UV resistant layer, but such layers and coatings have proven expensive and time consuming in the manufacturing process.

It is accordingly an object of the present invention to reduce the problem of UV degradation of the phosphor in an EL lamp by the use of a binder for the phosphor which is UV resistant.

It is another object of the present invention to provide a novel EL lamp and process with significantly reduced UV susceptibility without the need for an additional UV resistant layer or coating.

The control of different areas of illumination has long been a problem, and is addressed in the present invention by the use of multilayers, i.e., different phosphors may be screen printed or otherwise layered on the lamp in different steps to produce different colors, and the layering of dielectrics and metalized conductors over previous conductive layers permits electrical access to, and thus electrical control over, various areas of the lamp.

It is accordingly an object of the present invention to provide a novel EL lamp and process with enhanced electrical control over various areas of the lamp by the layering of dielectrics and conductors, and to provide lamps with different colors in different areas.

These and many other objects and advantages will be readily apparent to one skilled in the art to which the invention pertains from the claims and from a perusal of the following detailed description of preferred embodiments when read in conjunction with the appended drawings.

DESCRIPTION OF PREFERRED EMBODIMENTS

Figure 1:
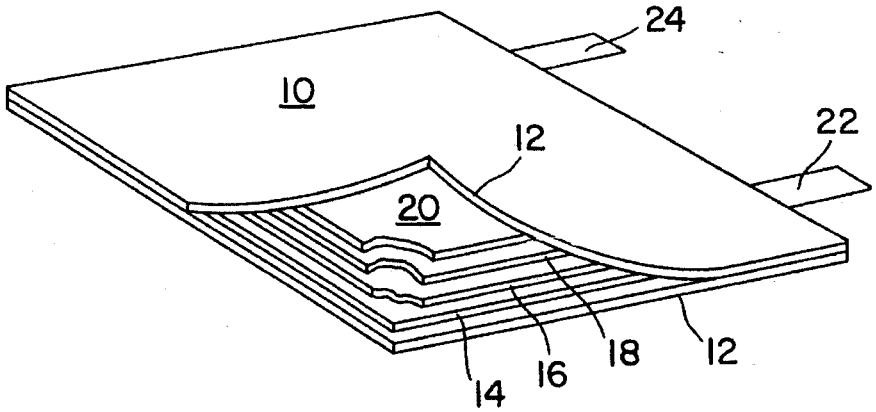
FIG. 1 is a pictorial view of a first embodiment of the lamp of the present invention.

Referring now to the drawings where exemplary embodiments of the electroluminescent cell or lamp of the present invention are illustrated, a flexible panel 10 such as shown in FIG. 1 may comprise a multilayer inner cell sealed within an outer moisture resistant envelope 12.

Within the active cell are four layers, i.e., a front electrode 14, a phosphor 16, a dielectric 18 and a rear electrode 20. The electrodes 14 and 20 may be provided with external silver leads 22 and 24 respectively in the screen printing process, or alternatively with ribbon connectors each being adapted for connection to a suitable source of a.c. power. As is well known in the art, the application of an electrical potential across the two electrodes 14 and 20 results in the excitation of the phosphor layer 16.

Figure 2:
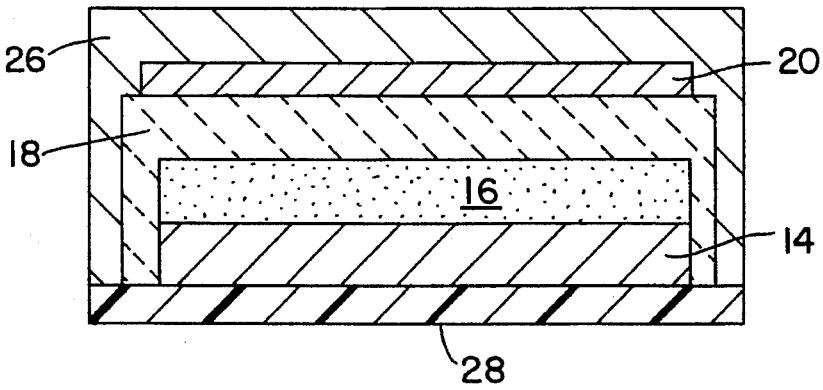
FIG. 2 is an elevation in cross-section of the lamp of FIG. 1.

As shown more clearly in the elevational view of a cross-section of FIG. 1 illustrated in FIG. 2, the phosphor 16 is immediately contiguous to the front electrode 14 but spaced from and electrically isolated from the rear electrode 20 by a dielectric layer 18. This phosphor sandwich is protected from the rear by an overcoat 26.

In the preferred screen printing manufacturing process, a suitable conventional heat stabilized polyester layer 28 such as the Melinex® ST525 film 5,000 to 7,000 microns thick commercially available from Imperial Chemical Industries PLC in Wilmington, Del. may form the foundation for the screen printing of a front conductor 14 thereon, with the conductor comprising suitable conventional ITO compounds in 50–85% in a binder made from a fluoropolymer resin, desirably 2-(2-ethoxyethoxy)-ethyl acetate, 2-butoxyethyl acetate, and polyvinylidene fluoride. In the preferred embodiment of FIG. 2, the weight percent of the binder components are 5–25%, 5–25% and 2–30% respectively and the thickness of the front electrode is 20–25 microns dry. The phosphor layer 16 may also be screen printed to a thickness of 45–50 microns dry and may include any suitable conventional phosphor such as copper activated zinc sulfide in the binder described above. In the preferred embodiment of FIG. 2, the copper activated zinc sulfide comprises 50–60 wt.%, the 2-(2-ethoxyethoxy)-ethyl acetate comprises 5–25 wt.%, the 2-butoxyethyl acetate comprises 5–25 wt.% and the polyvinylidene fluoride comprises 2–30 wt.%.

The dielectric layer 18 of FIG. 2 may include any suitable conventional white dielectric powder in the binder described above and screen printed to a thickness of 10–15 microns dry. In a preferred embodiment, the powder may be an admixture of titanium dioxide (20–60 wt.%), silicon dioxide (3–10 wt.%), and aluminum silicate (3–10 wt.%) and the binder in the same proportions described in connection with the phosphor layer 16.

The rear electrode 20 may also be screen printed to a thickness of 20–25 microns dry, and may include any suitable conventional conductive ink of silver, carbon, or ceramic, or blends of carbon silver or nickel silver in a binder as specified herein. In the preferred embodiment of FIG. 2, metallic silver (50–85 wt.%) may be used in a binder of 2-(2-ethoxyethoxy)-ethyl acetate (5–25 wt.%), 2-butoxyethyl acetate (5–25 wt.%) and polyvinylidene fluoride (2–30 wt.%).

The protective overcoat 26 may comprise any suitable conventional material such as Teflon® PFA powder available from E. I. DuPont & Company in the binder screen printed to a thickness of 15–20 microns. In the preferred embodiment of FIG. 2, with 15–25 wt.% of Teflon® #532–5011 powder, the weight percentages of the binder components are 2-(2-ethoxyethoxy)-ethyl acetate (10–45%), 2-butoxyethyl acetate (10–45%), and polyvinylidene fluoride (20–80%).

Figure 3:
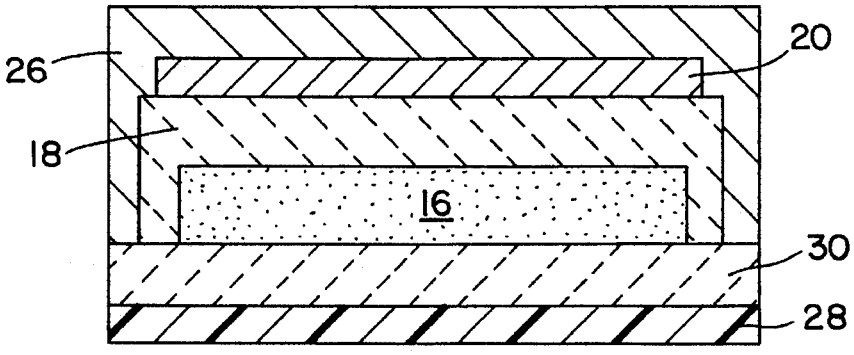
FIG. 3 is an elevation in cross-section of a second embodiment of the lamp of the present invention.

In the alternative embodiment shown in FIG. 3, the phosphor layer 16, the white dielectric 18, the rear electrode 20 and the protective overcoat 26 may be as described in connection with FIG. 2. However, the front electrode 28 may be a suitable conventional ITO sputtered polyester film with a sheet resistivity between about 300 ohms and 1,000 ohms per square, and a clear dielectric layer 30 may be screen printed thereon to a thickness of 2–5 microns dry to protect the electrode from moisture and abrasion. The clear dielectric layer 30 may comprise the formulation 2-(2-ethoxyethoxy)-ethyl acetate (10–45 wt.%), 2-butoxyethyl acetate (10–45 wt.%) and polyvinylidene fluoride (20–80 wt.%).

In both of the foregoing examples, a 2–10 wt.% of suitable conventional additives may be added to enhance the liquidity of the ink.

While not specifically illustrated in the drawings, the layering process easily achieved by screen printing permits the use of additional steps to print areas with different phosphors and thus different colors. Electrical access and thus control of the illumination of areas such as the concentric rings may be established by printing additional dielectric and conductive layers over previously printed conductive layers.

ADVANTAGES AND SCOPE OF INVENTION

By use of a fluoropolymer binder such as polyvinylidene fluoride for all of the layers of the lamp, a thick film lamp may be produced which has high resistance to many chemical solvents, to ultraviolet and nuclear radiation, weathering, fungi and a low water transmission rate, i.e., comparable to Aclar® PCTFE film commercially available from Allied-Signal, Inc. of Morristown, N. J.

The use of a common binder results in a lamp in which the various layers have a similar coefficient of temperature expansion, thus significantly reducing failures from exposure to an elevated temperature, and the inclusion of an ultraviolet absorbing component in the binder for at least the phosphor, and preferably all layers, obviates the need for and expense of an additional UV resistant coating.

The use of a common binder for both phosphor and adjacent dielectric layers reduces lamp failure due to localized heating, thus increasing light output for a given voltage and excitation frequency, and increasing the ability of the lamp to withstand overvoltage conditions without failure.

In addition, lamps constructed in accordance with the present invention have been found to produce more light at lower voltages and frequencies, and capable of withstanding higher voltages and frequencies without significant degradation of the lamp. In normal operation, it is possible to use individually coated phosphor with their enhanced moisture resistance without significant loss of illumination because of the ability to increase the operational voltage and/or frequency.

While acceptable for other methods of manufacture and deposition such as roller coating, sputtering and spraying, the binders of the present invention are particularly useful in the screen printing process. In addition, the printing process is particularly well suited to the printing of different phosphors in different layers of the lamp and the overprinting of conductive layers to achieve independent electrical control of various areas of the lamp.

While preferred embodiments of the present invention have been described, it is to be understood that the embodiments described are illustrative only and the scope of the invention is to be defined solely by the appended claims when accorded a full range of equivalence, many variations and modifications naturally occurring to those skilled in the art from a perusal hereof.

What is claimed is:

1. In a thick film, screen printed EL lamp with a front conductor layer, a dielectric layer, a phosphor layer, a rear conductor and protective overcoat layer, the improvement comprising the use of a common binder for all of the layers except the rear conductor layer to thereby reduce the susceptibility of the lamp to moisture wherein the front conductor layer comprises a heat stabilized polyester layer having a layer thereon by weight of:

(a) indium oxide compounds ( 50–85%);

(b) 2-(2-ethoxyethoxy)-ethyl acetate (5–25%);

(c) 2-butoxyethyl acetate (5–25%); and (f) polyvinylidene fluoride (2–30%).

2. The thick film, screen printed EL lamp of claim 1 wherein the front conductor layer has a thickness of about 20 to 25 microns dry.

3. The thick film, screen printed EL lamp of claim 1 wherein the front conductor layer comprises an indium tin oxide sputtered polyester having a sheet resistivity of 300 to 1,000 ohms per square and a clear dielectric comprising by weight:

(a) 2-(2-ethoxyethoxy)-ethyl acetate (10–45%);

(b) 2-butoxyethyl acetate (10–45%); and (c) polyvinylidene fluoride (20–80%).

4. The thick film, screen printed EL lamp of claim 3 wherein the clear dielectric has a thickness of about 2 to 5 microns dry.

5. In a thick film, screen printed EL lamp with front conductor layer, a dielectric layer, a phosphor layer, a rear conductor layer and a protective overcoat layer, the improvement comprising the use of a common binder for all of the layers except the rear conductor layer to thereby reduce the susceptibility of the lamp to moisture wherein the phosphor layer comprises by weight:

(a) copper activated zinc sulfide (50–60%);

(b) 2-(2-ethoxyethoxy)-ethyl acetate (5–25%);

(c) 2-butoxyethyl acetate (5–25%); and (d) polyvinylidene fluoride (2–30%).

6. The thick film, screen printed EL lamp of claim 5 wherein the phosphor layer has a thickness of about 45 to 50 microns dry.

7. In a thick film, screen printed EL lamp with a front conductor layer, a white dielectric layer, a phosphor layer, a rear conductor and a protective overcoat layer, the improvement comprising the use of a common binder for all of the layers except the rear conductor layer to thereby reduce the susceptibility of the lamp to moisture wherein the white dielectric layer comprises by weight:

(a) titanium dioxide (20–60%);

(b) silicon dioxide (3–10%);

(c) aluminum silicate (3–10%);

(d) 2-(2-ethoxyethoxy)-ethyl acetate (5–25%);

(e) 2-butoxyethyl acetate (5–25%); and (f) polyvinylidene fluoride (2–30%).

8. The thick film, screen printed EL lamp of claim 7 wherein the white dielectric layer has a thickness of about 10 to 15 microns dry.

9. In a thick film, screen printed EL lamp with front conductor, dielectric, phosphor, rear conductor and protective overcoat layers, the improvement comprising the use of a common binder for all of the layers except the rear conductor layer to thereby reduce the susceptibility of the lamp to moisture wherein the protective overcoat layer comprises by weight:

(a) Teflon #532–5011 power (15–25%);

(b) 2-(2-ethoxyethoxy)-ethyl acetate (10–45%);

(c) 2-butoxyethyl acetate (10–45%); and (f) polyvinylidene fluoride (20–80%).

10. The thick film, screen printed EL lamp of claim 9 wherein the protective over coat layer has a thickness of about 15 to 20 microns dry.

11. A thick film EL lamp comprising: .

a front electrode layer comprising a heat stabilized polyester film with a layer of indium tin oxide in a first fluoropolymer resin binder;

a phosphor layer in a second fluoropolymer resin binder;

a dielectric layer in a third fluoropolymer resin binder;

a rear electrode layer in a binder; and an overcoat layer in a fourth fluoropolymer resin binder.

12. The thick film EL lamp of claim 11 wherein each of said fluoropolymer resin binders includes polyvinylidene fluoride.

13. The thick film EL lamp of claim 11 wherein the phosphor layer comprises individually coated phosphor particles.

14. A thick film EL lamp comprising:

a front electrode layer comprising an indium tim oxide sputtered polyester having a sheet resistivity of 300 to 1,000 ohms per square;

a clear dielectric in a first fluoropolymer resin binder;

a phosphor layer in a second fluoropolymer resin binder;

a dielectric layer in a third fluoropolymer resin binder;

a rear electrode layer in a binder; and an overcoat layer in a fourth fluoropolymer resin binder.

15. The thick film EL lamp of claim 14 wherein each of said fluoropolymer resin binders includes polyvinylidene fluoride.

16. The thick film EL lamp of claim 14 wherein said phosphor comprises individually coated phosphor particles.

* * * * *